US008210373B2

(12) United States Patent
Liao

(10) Patent No.: US 8,210,373 B2
(45) Date of Patent: Jul. 3, 2012

(54) STRUCTURE OF PARTS STAND

(75) Inventor: Po-Lin Liao, West Dis. Taichung (TW)

(73) Assignee: Lih Yann Industrial Co. Ltd., Taichung (TW)

( * ) Notice: Subject to any disclaimer, the term of this patent is extended or adjusted under 35 U.S.C. 154(b) by 330 days.

(21) Appl. No.: 12/612,251

(22) Filed: Nov. 4, 2009

(65) Prior Publication Data

US 2011/0100940 A1 May 5, 2011

(51) Int. Cl.
*A47J 47/00* (2006.01)

(52) U.S. Cl. ..... 211/131.1; 211/144; 211/163

(58) Field of Classification Search ..... 211/131.1, 211/10, 133.4, 196, 205, 166, 107, 36, 70, 211/95, 115, 129.1, 144, 163; 108/94, 95, 108/139, 59, 106, 144.11; 248/127, 128, 248/130, 131, 151

See application file for complete search history.

(56) References Cited

U.S. PATENT DOCUMENTS 2,526,245 A * 10/1950 Lathrop ..... 108/28
4,549,664 A * 10/1985 Gowan et al. ..... 211/131.1
4,807,837 A * 2/1989 Gawlik et al. ..... 248/125.8
5,312,003 A * 5/1994 Domenig ..... 211/144
5,947,306 A * 9/1999 Chang ..... 211/85.23
6,206,493 B1 * 3/2001 Sanchez-Levin et al. .... 312/125
6,502,707 B1 * 1/2003 Sullivan ..... 211/163
8,051,994 B2 * 11/2011 Jin et al. ..... 211/163
2003/0015486 A1 * 1/2003 Chen ..... 211/70
2009/0255883 A1 * 10/2009 Boyd et al. ..... 211/70

* cited by examiner

*Primary Examiner* — Jennifer E. Novosad
(74) *Attorney, Agent, or Firm* — Muncy, Geissler, Olds & Lowe, PLLC

(57) ABSTRACT

A parts stand includes a base that is coupled to and supports a coupling collar with a cylindrical section thereof. The coupling collar is coupled to and supports a tray. A support collar is then assembled thereto and another tray is further assembled. Guide blocks of the tray engage lug plates of the support collar. Afterwards, the support collars is coupled to another support collar, and the another support collars is fit into another tray, so that the trays are vertically and sequentially stacked. The parts stand may further include a coupling tube composed of tubular sections extending internally the parts stand and a coupling bar composed of bar segments extending internally through the coupling tube. The coupling bar is secured to a bottom cap and a crown tray with bolts to facilitate smooth rotation of the trays of the parts stand. The trays form storage chambers for storing parts. The trays and the support collars or the coupling collar are rotatable on the base or other support collars to facilitate access to the parts. An additional small-sized tray can be selectively provided above the trays to facilitate access to the parts stored in the next large-sized tray.

14 Claims, 9 Drawing Sheets

STRUCTURE OF PARTS STAND

BACKGROUND OF THE INVENTION

1. Field of the Invention

The present invention relates to an article storage container, and in particular to a structure of a parts stand.

2. The Related Arts

The progress of technology brings in a lot of new products. With the number of new products being increased, the number of parts of the new products is dramatically increased. When these parts are mixed together, it would be difficult to look for and find a desired one, and it is easy to get a wrong part. To separately store various parts with different cases or boxes, a great number of boxes are needed and access of the parts requires pick up and open selected boxes. This is a tough job. A rotatable container with several layers that store different parts would allow for easy access and inspection of the stored parts. This was not available in the market yet and thus access of the parts has to be done with much effort as discussed above.

Thus, it is desired to provide a structure or device that overcomes these problems.

SUMMARY OF THE INVENTION

Thus, the present invention aims to solve the problems that the number of parts is getting increased and the parts, once mixed together, is hard to identified and selected and may easily lead to incorrect pick-up of parts and that storage of different parts in separate boxes makes it troublesome to identify and select a box and it is also tired and hard to open the boxes. A solution presented herein is a rotatable device that comprises several layers that store different parts to allow for easy access and inspection of the stored parts. This was not available in the market yet and thus access of the parts has to be done with much effort as discussed above To solve such problems and drawbacks, the present invention provides a parts stand, comprising: a base, which has an outer circumferential surface that forms circumferentially and equally spaced connection slots to which coupling sections of a plurality of radially extending foot members are coupled, the base further comprising a central hollow post that has an outer circumferential surface to which paired L-shaped reinforcement ribs corresponding to and coupling the foot members are mounted to oppose each other for receiving and supporting the foot members, the reinforcement ribs having substantially and horizontally aligned top ends, which all together define a support surface on a horizontal plane, the hollow post having a top end that forms a hollow cylindrical section extending upward from the support surface, the hollow post comprising reinforcement ribs formed on an inner circumference thereof; a coupling collar, which is fit to the cylindrical section of the base, the coupling collar being fit to a ring pad and further fit to a tray; a plurality of support collars, each of which has a lower end which forms a circumferential flange that is horizontally and radially expanded, the support collar defining a bore and a through hole that extends upward from and communicates the bore and comprises reinforcement ribs therein, the support collar having an outer circumferential surface to which a plurality of lug plates is mounted in an equally and angularly spaced manner, the support collar comprising a hollow cylindrical section extending upward from the lug plates; a plurality of trays, each of which comprises internal ribs that extend radially from a central hub that defines a central bore, the internal ribs having top faces in which through holes are defined, the internal ribs serving as partitions of the tray, the hub having a top circumference from which a circumferential stop flange extends inward, whereby the bore is slightly greater than an outside diameter of the lug plates and the stop flange defining a hole that is slightly greater than the cylindrical section of the support collar, paired guide blocks being provided on an inside surface of the hub to receive each of the lug plates of the support collar therein, the internal ribs being made hollow, each tray forming an outward expanded rim along an outer circumference thereof; whereby the base is coupled to and supports the coupling collar with the cylindrical section thereof, the coupling collar is coupled to and supports the bottom tray and the bore of one of the support collars with a cylindrical section thereof, and the one of the support collars is fit into and coupled to one of the trays with the guide blocks of the one of the trays engaging the lug plates of the one of the support collars, and then, the one of the support collars is fit to another one of the support collars, the another one of the support collars being fit into another one of the trays, so that the trays are vertically and sequentially stacked, the trays and the support collars being rotatable on the base and other support collars to adjust angular positions thereof to facilitate access of parts stored in the trays. The parts stand may further comprise a small-sized tray provided above a top one of the trays to facilitate access to the parts stored in a next large-sized tray. The parts stand is detachable. The parts stand further comprises a coupling tube composed of tubular sections extending internally the parts stand and a coupling bar composed of bar segments extending internally through the coupling tube. The coupling bar is secured to a bottom cap and a crown tray with bolts to facilitate smooth rotation of the trays of the parts stand.

The effectiveness of the present invention is that, compared to the conventional parts storage, the trays of the parts stand of the present invention are individually rotatable so that parts stored in any location of the parts stand can be easily accessed. Further, the trays are arranged in a vertically stacked, multiple-layered fashion, which allows for storage of a great number of parts. Most importantly, the trays of the parts stand are of an open design, allowing for visual inspection of the parts stored so as to facilitate efficient pick-up of correct parts.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

The present invention provides an improved structure of a parts stand of which an embodiment in accordance with the present invention will be described in details as follows.

Figure 1:
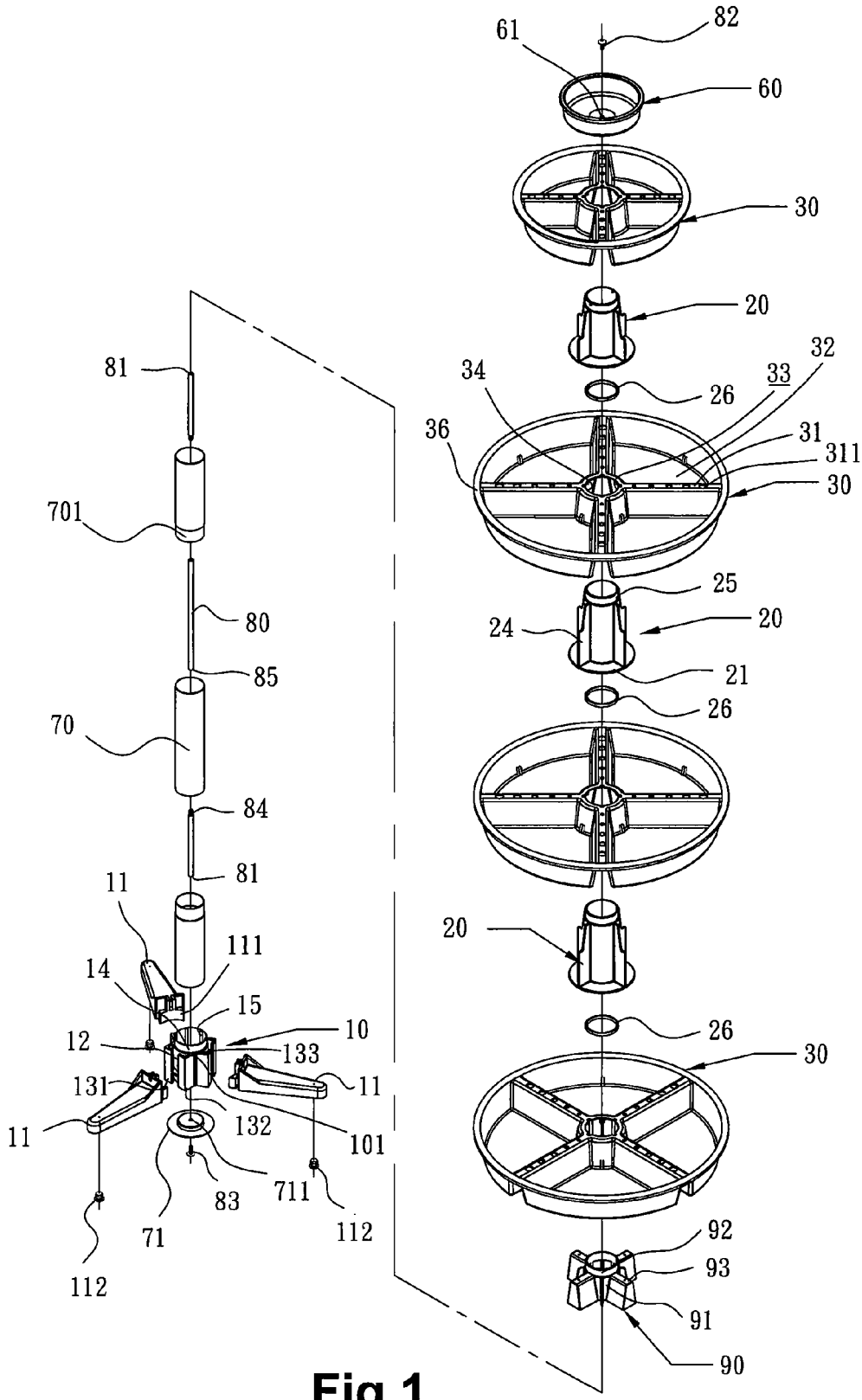
FIG. 1 is an exploded view of a parts stand constructed in accordance with an embodiment of the present invention.
Figure 2:
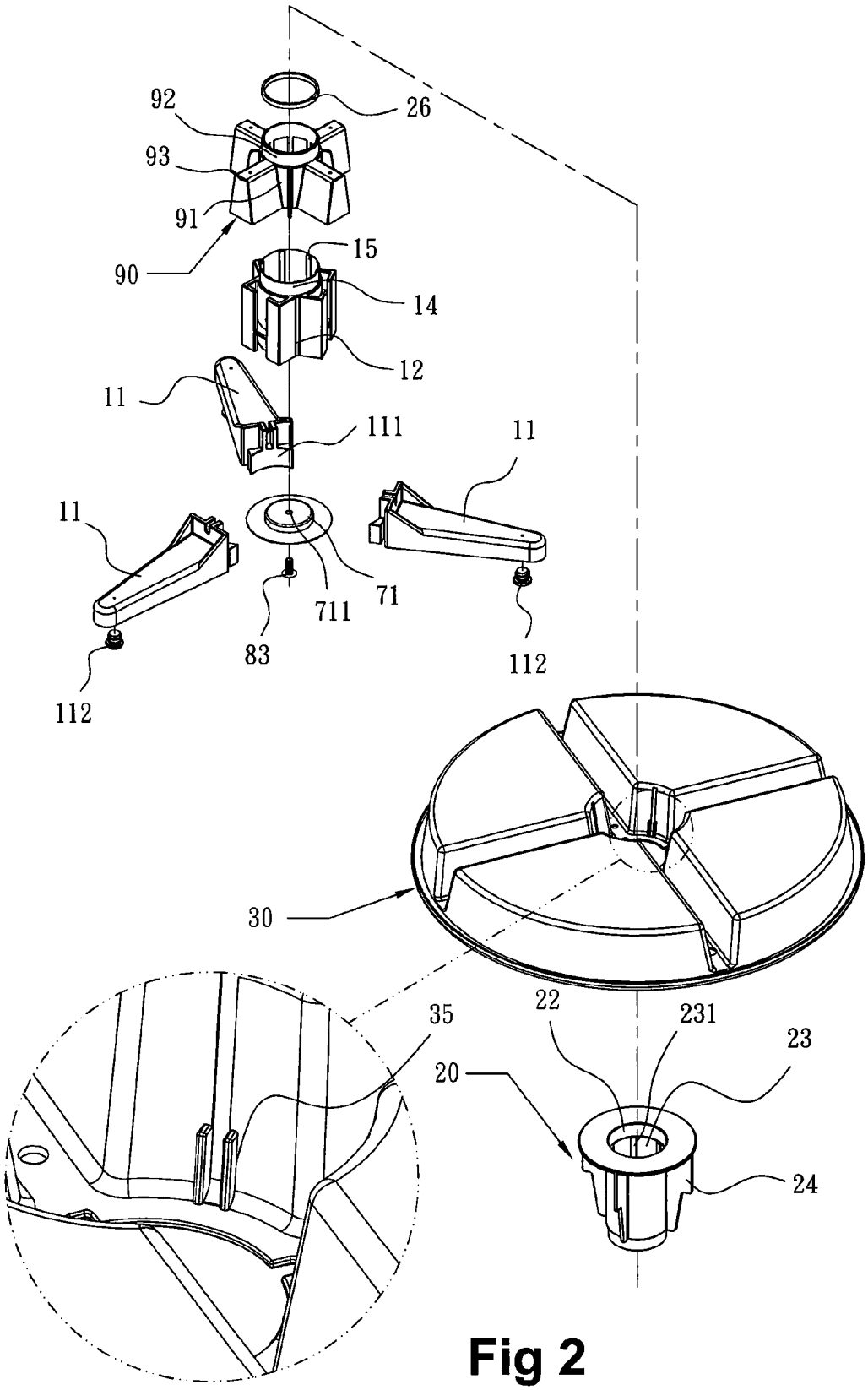
FIG. 2 is an exploded view, in an enlarged fashion, of a stand base and a storage tray, which is shown in an inverted fashion, of the parts stand of the present invention, an encircled portion of FIG. 2 being enlarged for clearly showing structural details of the storage tray.

Reference is first made to FIGS. 1 and 2, which show, respectively, an exploded view of the parts stand of the present invention and an exploded view, in an enlarged fashion, of a stand base and a storage tray, which is shown in an inverted fashion, of the parts stand of the present invention. The parts stand is generally composed of the stand base, generally designated at 10, and at least one storage tray 30 rotatably supported on the base 10 by a support collar 20 or a coupling collar 90.

The base 10 has an outer circumferential surface to which a plurality of paired reinforcement ribs 131, 132 circumferentially opposing and spaced from each other is mounted, whereby each pair of reinforcement ribs 131, 132 defines a connection slot 101 to which a coupling section 111 of a foot member 11 is received and coupled to have the foot member 11 extend radially and preferably horizontally from a bottom of the base 10. In the embodiment illustrated, three pairs of reinforcement ribs 131, 132 are provided, preferably in an equally and angularly spaced manner, on the circumferential surface of the base 10 and thus the base 10 is supported by three foot members 11 respectively attached to the three pairs of reinforcement ribs 131, 132. If desired, a pad 112 can be attached to an underside of each foot member 11 adjacent to a distal free end of the foot member 11.

In the embodiment illustrated, the base 10 is formed of a central hollow post 12 that provides the outer circumferential surface, and the reinforcement ribs 131, 132 are made L-shaped and opposing each other to define the connection slot 101 therebetween. The reinforcement ribs 131, 132, as mounted to the outer circumferential surface of the post 12, show substantially and horizontally aligned top ends, which all together define a support surface 133 on a horizontal plane. The hollow post 12 of the base 10 has a top end that is formed on a hollow cylindrical section 14 extending upward from the support surface 133. Further, reinforcement ribs 15 are formed on an inner circumference of the hollow post 12.

The parts stand of the present invention comprises at least one storage tray 30 rotatably supported on the base 10. In an embodiment, only one storage tray 30, which is referred to as a bottom tray, is included in the parts stand. However, preferably and as shown in the embodiment illustrated, a number of storage trays 30 is provided, including a bottom tray 30 and a top tray 30 and further including at least one intermediate tray 30 set between the bottom and top trays 30. Each tray 30 is fit to and supported by a support collar 20, except that the bottom tray 30 is fit to and supported by the coupling collar 90. Thus, in the instant embodiment, a plurality of support collars 20, including one supporting the top tray 30 and at least one supporting at least one intermediate tray 30, is used in the parts stand of the present invention.

Each support collar 20 has a lower end to which a circumferential flange 21 that is horizontally and radially expanded from the lower end circumference is attached. The support collar 20 is hollow and defines a bore 22 in a lower portion thereof and further forms a through hole 23 that extends upward from and communicates the bore 22, preferably in an axially aligned manner. Reinforcement ribs 231 are formed in the through hole 23. The support collar 20 has an outer circumferential surface to which a plurality of lug plates 24 is mounted, preferably in an equally and angularly spaced manner. In the instant embodiment, four lug plates 24 are provided. The support collar 20 comprises a hollow cylindrical section 25 extending upward from top ends of the lug plates 24. A ring pad 26 is preferably provided between vertically adjacent support collars 20.

Each of the storage trays 30 comprises internal ribs 31 that extend radially from a central hub that defines a central bore 33. Preferably, the internal ribs 31 together form a cross form partition that divides an internal space of the tray 30 into a plurality of recessed storage chambers 32 respectively delimited by angularly adjacent ribs 31. The internal ribs 31 that are raised above the recessed storage chambers 32 have top faces in which a plurality of through holes 311 is defined. The hub of the tray 30 is formed of an inner circumferential wall that delimits the central bore 33. A circumferential stop flange 34 extends inwards from a top circumference of the wall. The bore 33 of the tray 30 is of a size substantially corresponding to or slightly greater than an outside diameter of the lug plates 24 of the support collar 20 that supports the tray 30 and the stop flange 34 defines a central hole that is sized slightly greater than the cylindrical section 25 of the support collar 20 but, preferably, smaller than the outside diameter of the lug plates 24, whereby the support collar 20 is allowed to fit, from the underside, into the central bore 33 of the tray 30. The circumferential wall of the tray 30 that delimits the central bore 33 has an inside surface from which the stop flange 34 extends inward. Paired guide blocks 35 are provided on the inside surface of the circumferential wall to define a slot into which each of the lug plates 24 of the support collar 20 is slidably fit so as to rotatably fix the tray 30 and the support collar 20 together. In the instant embodiment, each of the lug plates 24 shows an L-shape having a vertical section that is slidably fit into the slot defined by associated pair of guide blocks 35 and a horizontal section on which a bottom of the tray 30 is seated and supported.

Further, in the instant embodiment, each internal rib 31 is made hollow by recessing the bottom thereof. The tray 30 also has an outer circumferential wall radially spaced from the inner circumferential wall and forming an outward expanded rim 36 at a top circumference thereof.

The coupling collar 90 is provided to support the bottom tray 30 and is arranged between the base 10 and the bottom tray 30, which is the one of the storage trays 30 that is placed most closed to the base 10. The coupling collar 90 comprises a hollow tubular body 91 that is configured and sized to fit to the base 10 to be supported by the support surface 133 of the base 10. The coupling collar 90 comprises a hollow cylindrical section 92 in an upper portion thereof and a cross-form projecting section 93, which comprises a plurality of (four in the instant embodiment) arms radially extending from the tubular body 91, in a lower portion thereof. A ring pad 26 is preferably arranged between the coupling collar 90 and the support collar 20 of the tray 30 that is next above the bottom tray 30. The coupling collar 90 is fit from underside into the central bore 33 of the bottom tray 30 with the arms of the projecting section 93 received in the recessed bottoms of the internal ribs 31 of the bottom tray 30 to rotatably fix the bottom tray 30 and the coupling collar 90 together.

A crown tray 60 is arranged above the top tray 30, if any, or above the bottom tray 30, if only one storage tray is included in the parts stand.

A coupling tube is formed of a plurality of tubular sections 70, which extends through the hollow post 12 of the base 10 and the through hole 23 (as well as the bore 22) of each support collar 20. A topmost tubular section 70 has a top end supporting a bottom of the crown tray 60, while a bottommost tubular section 70 has a bottom end that is mounted to and closed by a cap 71. The tubular sections 70 selectively comprise reduced ends 701 for fitting into and coupling with adjacent tubular sections 70 to form the coupling tube.

A coupling bar is formed of a plurality of bar segments 80, including a topmost segment and a bottommost segment, which have ends opposite to each other and forming internally-threaded holes 81. The crown tray 60 and the cap 71 define through holes 61, 711. The coupling bar extends through the coupling tube, which is in turn received through an assembly of the crown tray 60, the trays 30, the support collars 20, the ring pads 26, the coupling collar 90, and the base 10, whereby the internally threaded holes 81 of the topmost and bottommost segments 80 of the coupling bar are respectively set in alignment with the through holes 61, 711 of the crown tray 60 and the cap 71 and are secured thereto by bolts 82, 83 received through the through holes 61, 711 and engaging the internally threaded holes 81 of the coupling bar. In this way, the storage trays 30 and the associated support collar 20 and coupling collar 90 are secured together in a manner that the storage trays 30 are allowed to rotate about the coupling tube formed of the tubular sections 70.

Intermediate segments 80 of the coupling bar are connected to each other by any known means, for example mated external thread 84 and internal thread 85.

Figure 3:
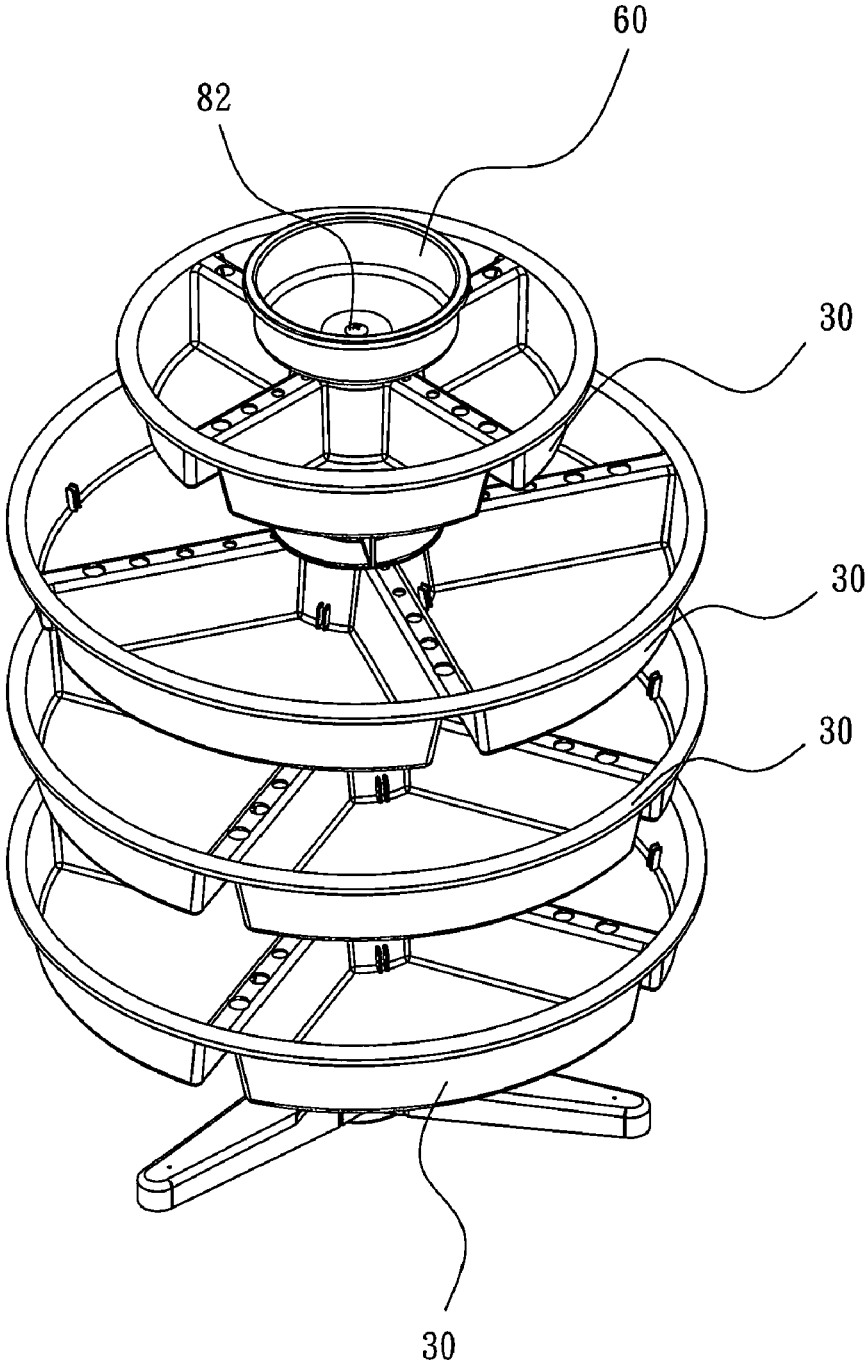
FIG. 3 is perspective view of the parts stand of the present invention in an assembled form.
Figure 4:
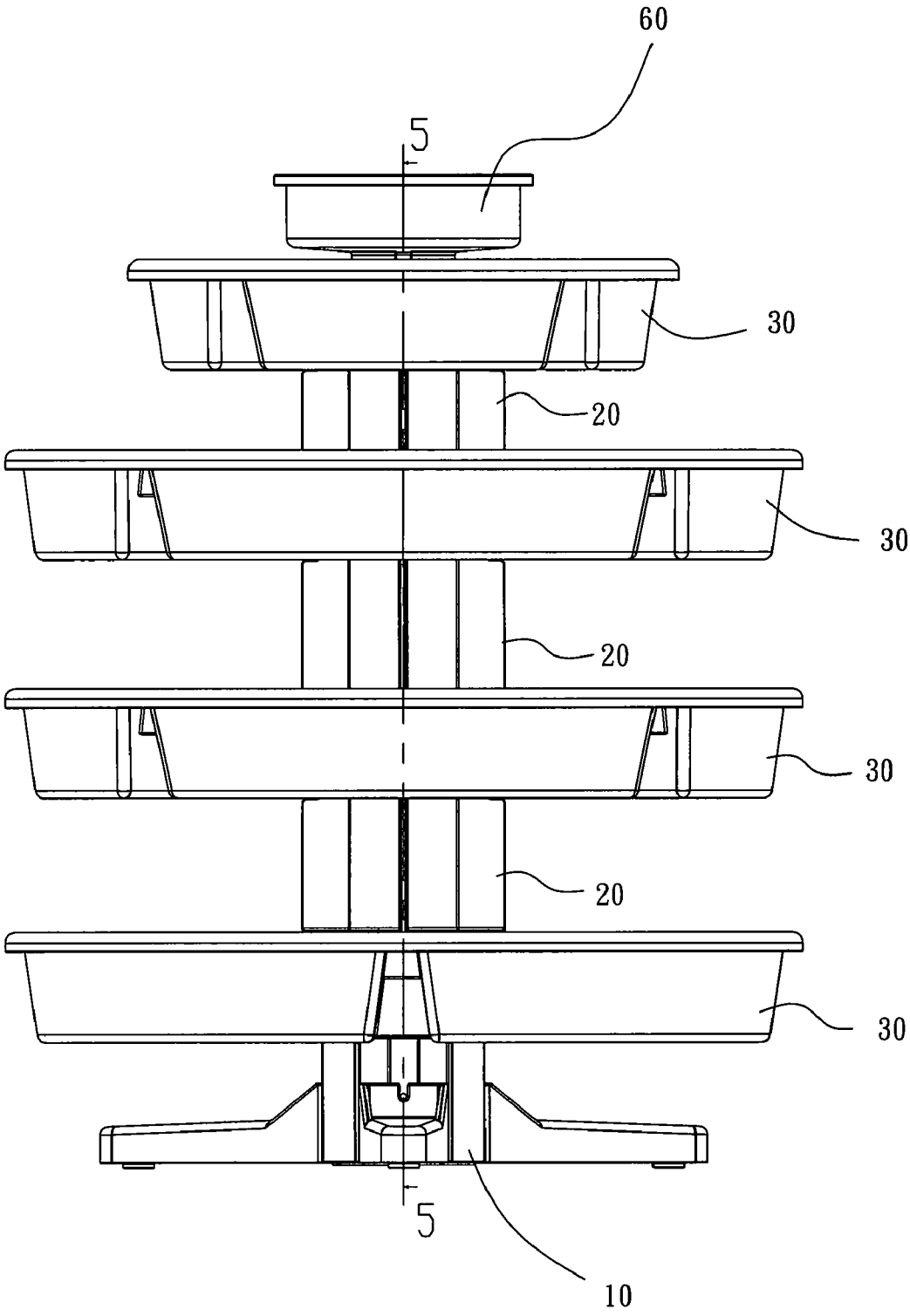
FIG. 4 is a side elevational view of the parts stand of the present invention in the assembled form.
Figure 5:
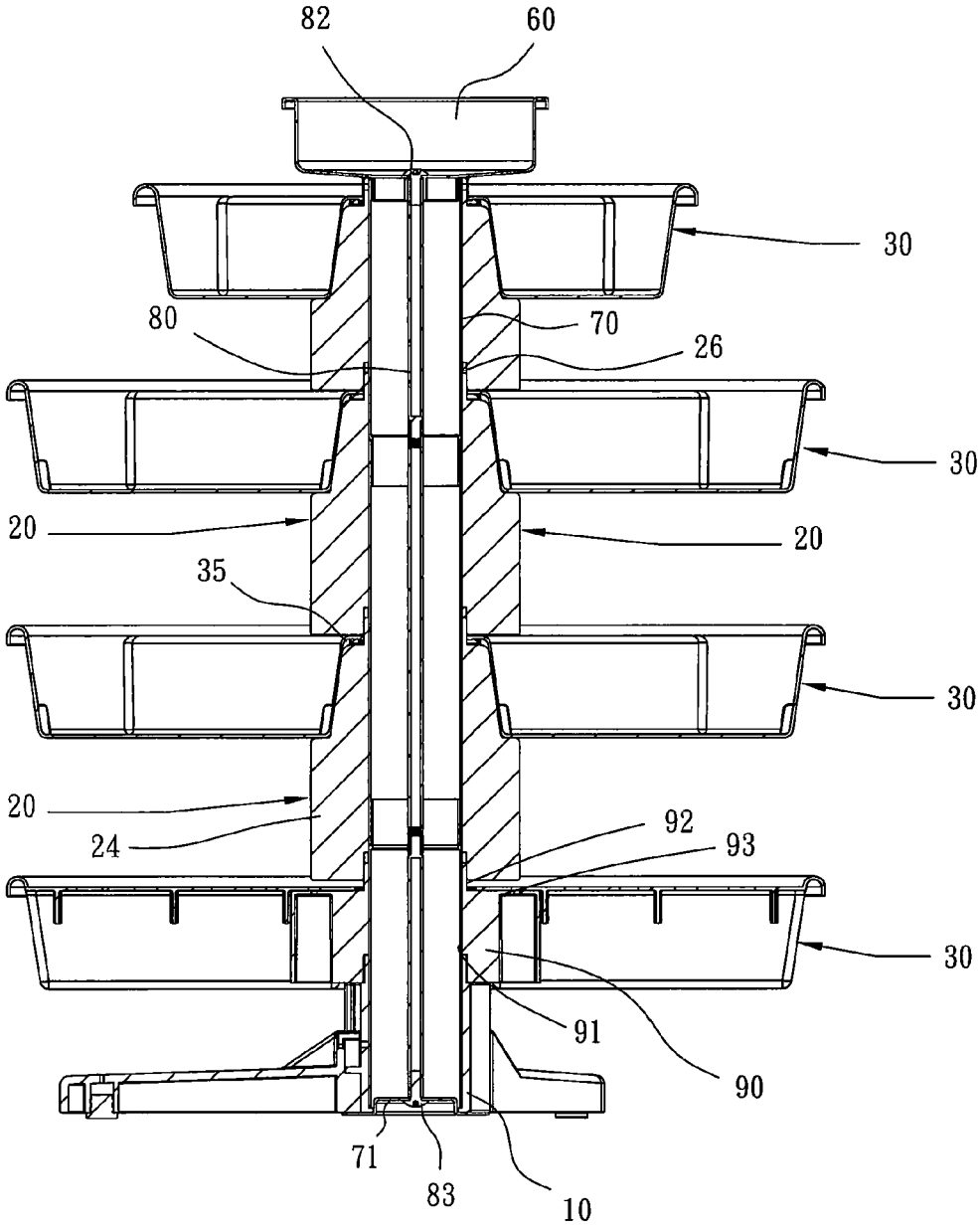
FIG. 5 is a cross-sectional view of the parts stand of the present invention in the assembled form.

Reference is now made to FIGS. 3-5, which respectively show a perspective view, a side elevational view, and a cross-sectional view of the parts stand of the present invention in an assembled form. The base 10 is coupled to and supports the tubular body 91 of the coupling collar 90 with the cylindrical section 14 of the base 10. The coupling collar 90 is coupled to and supports the bottom tray 30 and the cylindrical section 92 of the coupling collar 90 is fit to a ring pad 26 and the bore 22 of the support collar 20 located just above the coupling collar 90, and the support collar 20 is fit into and coupled to an associated tray 30 with the guide blocks 35 of the tray 30 engaging the lug plates 24 of the support collar 20. Then, the support collar 20 is fit to a ring pad 26 and a vertically adjacent support collar 20, and the vertically adjacent support collar 20 is further fit into and coupled to an associated tray 30. This is repeated until a desired number of storage trays 30 is vertically stacked. The storage trays 30 and the associated support collars 20 or the coupling collar 90 can be rotated on the base 10 or on the ring pads 26 of other support collars 20 to adjust angular positions thereof to facilitate access of parts stored in any storage chambers 32 of any storage trays 30. Preferably, the storage trays 30 are of different sizes and stacked in such a way that trays 30 are smaller in the upper side and larger in the lower side, or alternatively, the trays 30 are of substantially the same size, but an additional smaller tray 30 is provided above the topmost one of the trays of the same size and the crown tray 60 is then stacked on the additional smaller tray 30. In this way, the access to the parts contained in the trays 30 is facilitated. The components of the parts stand can be easily detached and the trays are coupled together through the coupling tube (which is formed of tubular sections 70) and the coupling bar (which is formed of bar segments 80) and are secured to the cap 71 and the crown tray 60 by bolts 82, 83 so that the rotation of the trays is made easy and smooth.

Figure 6:
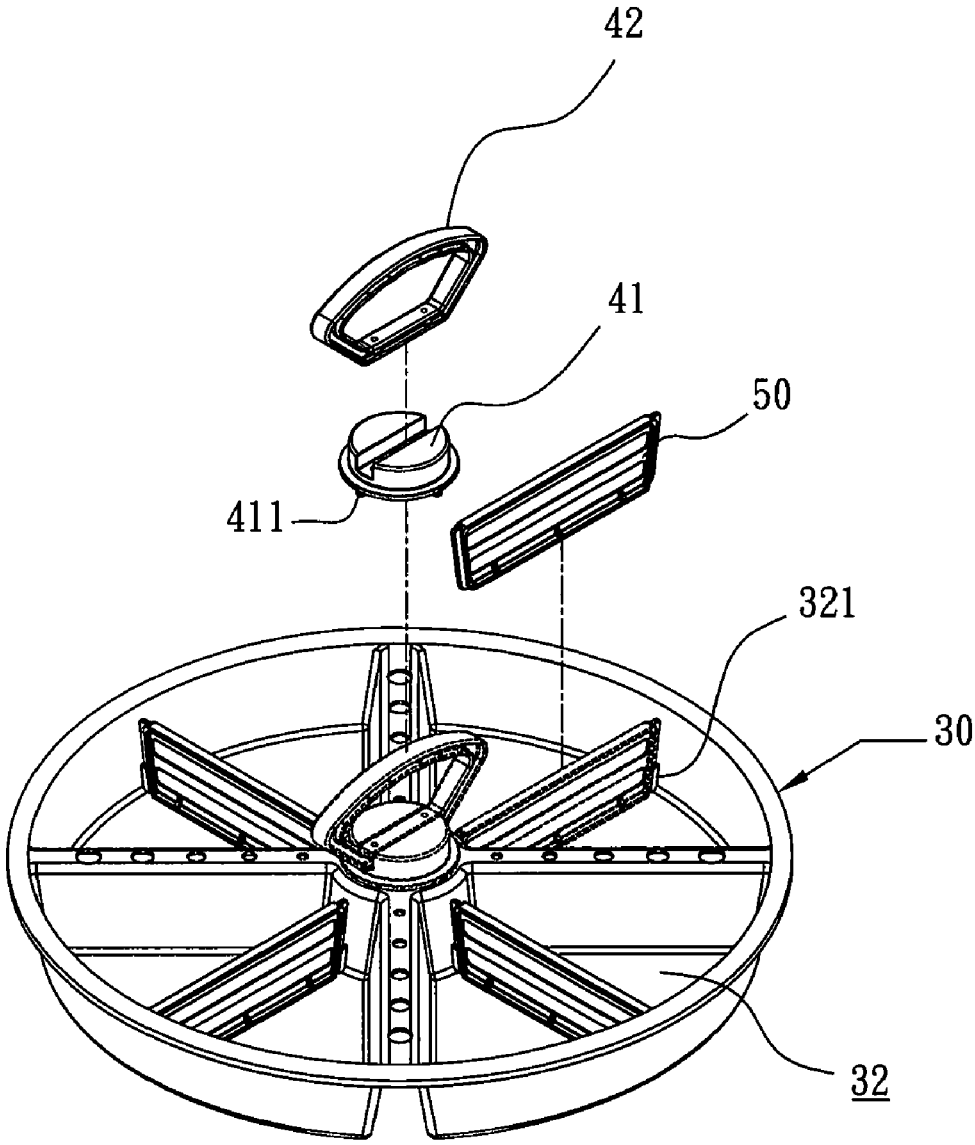
FIG. 6 is a perspective view of a storage tray in accordance with the present invention to which a handle mounted to a handle retainer and partition boards are selectively mounted, wherein the handle, the handle retainer, and one partition board are shown detached from the tray, and the handle, the handle retainer, and the one partition board being additionally shown in phantom lines of being attached to the tray.
Figure 7:
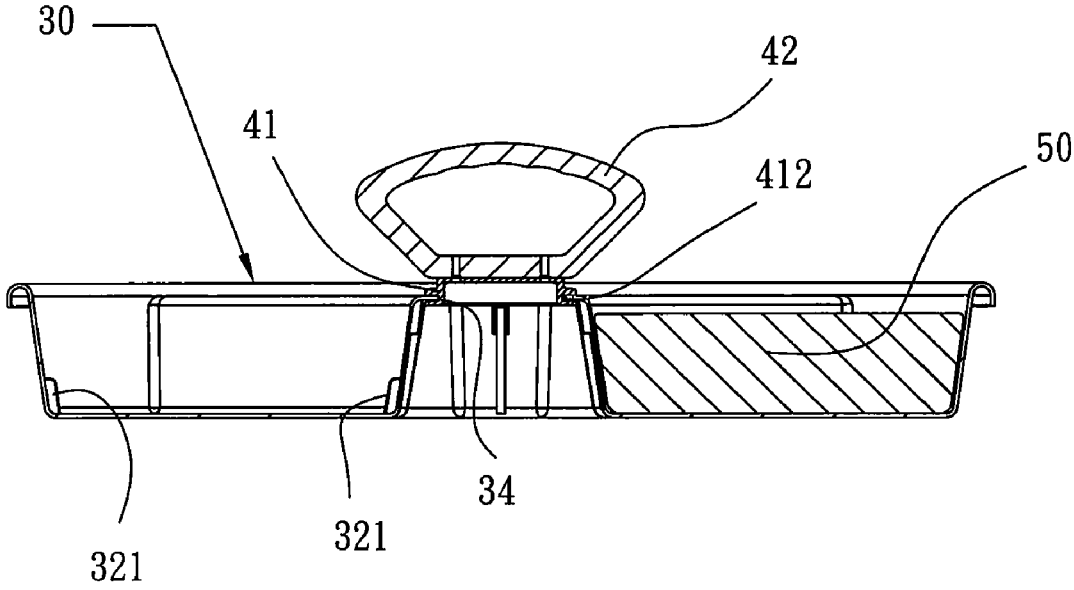
FIG. 7 is a cross-sectional view of the tray to which the handle and the partition boards are mounted.

Referring to FIGS. 6 and 7, the central bore 33 of the tray 30 (see FIG. 1) forms, in a circumference thereof or in the stop flange 34, a plurality of cutoffs 331, preferably in four angularly and equally spaced locations. A handle retainer 41 carries a handle 42. The handle retainer 41 has a bottom on which four projections 411 are formed, preferably in four angular and equally spaced locations. The projections 411 define a circumferential slot 412. The projections 411 of the handle retainer 41 are allowed to pass through the cutoffs 331 of the central bore 33 of the tray 30 to such a location where the slot 412 aligns the stop flange 34. By rotating the handle retainer 41 under this aligned condition, the projections 411 engage and are fixed by the stop flange 34, whereby the handle retainer 41 is securely attached to the tray 30. In this way, the tray 30 can be easily removed and carried away to any desired location by the handle 42.

Each storage chamber 32 of the tray 30 is provided with two radially opposite pairs of guide blocks 321, which are preferably set by or formed on opposing surface of the internal and external circumferential walls of the tray 30 so that each pair of guide blocks 321 receives one of opposite end edges of a partition board 50 therein to set the partition board 50 inside the storage chamber 32. In this way, the storage chamber 32 is further divided into two sub-chambers.

Figure 8:
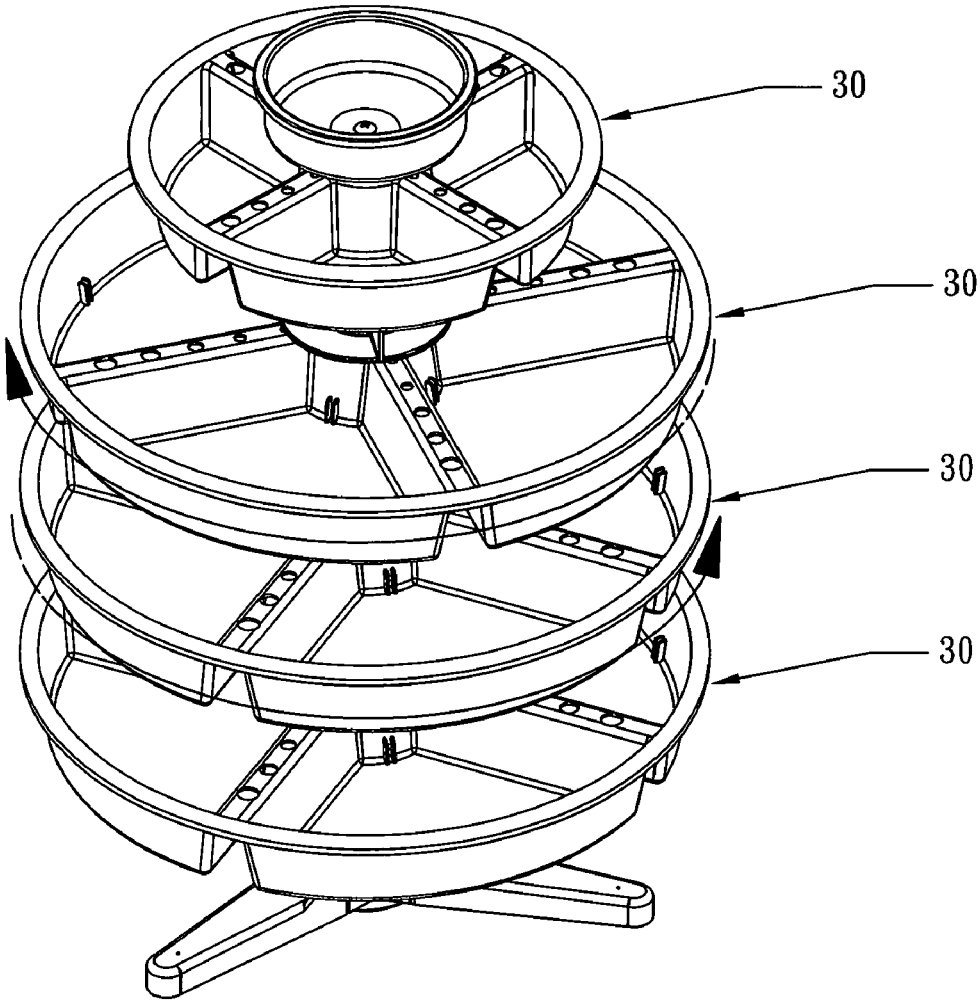
FIG. 8 is a perspective view of the parts stand, illustrating the rotation of individual storage trays of the parts stand.
Figure 9:
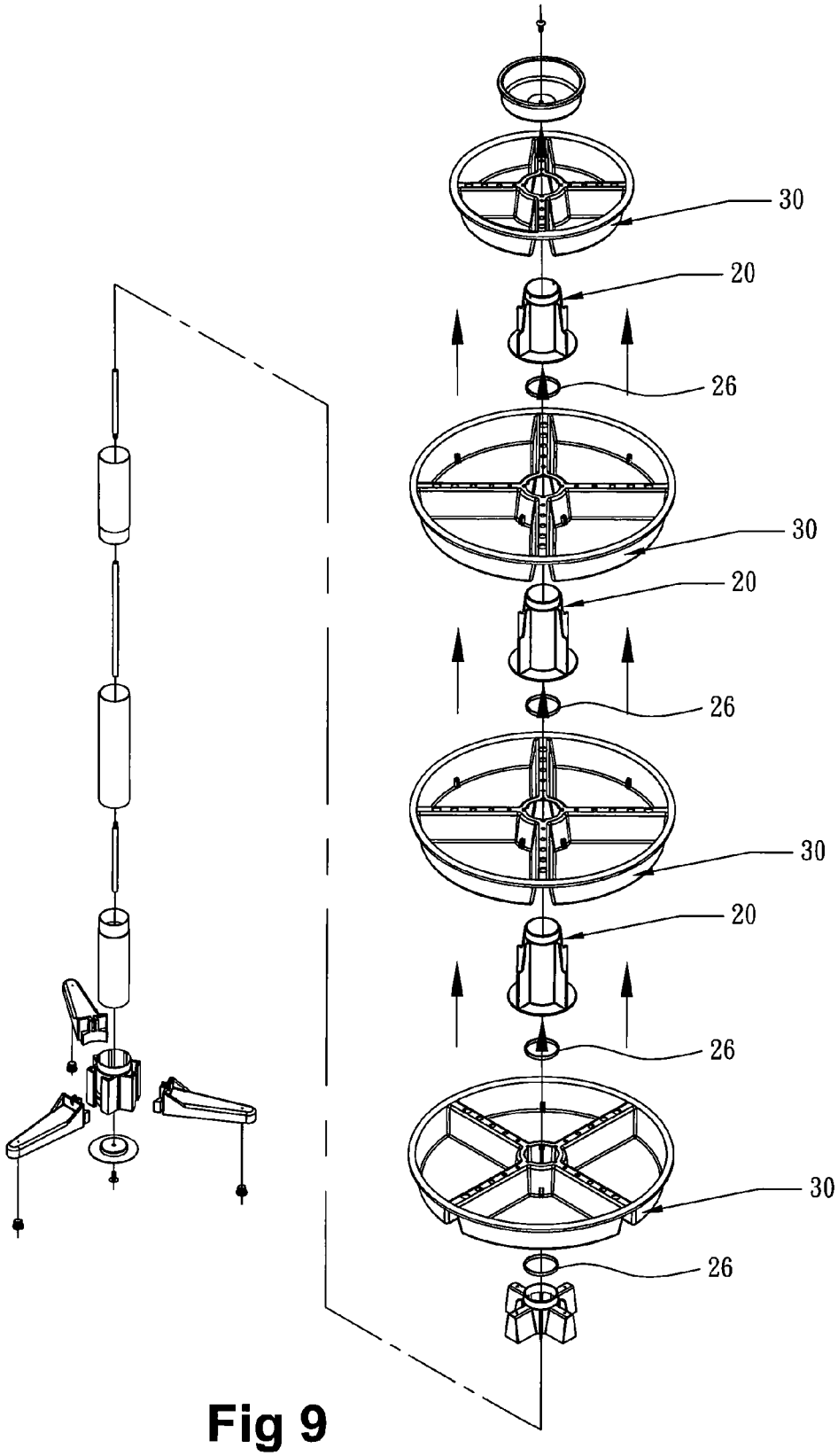
FIG. 9 is a view illustrating detaching constituent components of the parts stand.

Referring to FIGS. 8 and 9, each tray 30 and the support collar 20 coupled thereto can be independently rotated both clockwise and counterclockwise. This independently rotatable arrangement, together with the open design of the tray 30, allows for easy access and search of parts contained in the tray.

As shown in FIG. 9, the storage trays 30, the support collars 20, and the ring pads 26 of the parts stand can be easily detached in a vertically upward direction.

To this point, it can be realized that the present invention offers the following advantages:

(1) A novel structure of a parts stand is provided, which allows storage trays to be independently rotatable, whereby parts stored in any location of the stand can be easily accessed. Further, the trays are arranged in a vertically stacked manner, which allows for mass storage of a great number of parts. Most importantly, the storage trays of the parts stand are of an open design, which allows for easy visual observation and inspection of parts stored in the trays so as to realize efficient selection and pick up of parts. The components of the parts stand are easily detachable, making the use of the stand easy and convenient.

(2) In the novel structure of the parts stand, major components include a base, a coupling collar, a number of support collars, a coupling tube formed of several tubular sections, a coupling bar formed of several bar segments, and a number of storage trays, and these constituent components can be easily assembled and detached. Further, depending on the applications of the parts stand, the number of the trays can be arbitrarily selected. Further, each tray is independently rotatable and each tray is of an open design to allow for easy observation and efficient pick up of parts, making the use of the parts stand convenient.

(3) The parts stand is assembled through a coupling tube formed of a plurality of tubular sections that secures the support collars together in a rotatable manner. The support collars are stacked with ring pads interposed therebetween to facilitate rotation of the trays to which the support collars are coupled. The coupling tube receives a coupling bar formed of a plurality of bar segments to extend therethrough and the coupling bar are secured to a bottom cap and a top crown tray by bolts so as to prevent undesired separation of the trays from each other.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A parts stand, comprising:

a base, which comprises a plurality of foot members radially extending from a bottom section of the base and a hollow post that has an outer circumferential surface to which paired L-shaped reinforcement ribs corresponding to and coupling the foot members are mounted to oppose each other for receiving and supporting the foot members, the reinforcement ribs having substantially and horizontally aligned top ends, the top ends of the reinforcement ribs collectively defining a support surface on a horizontal plane, the hollow post having a top end that forms a hollow cylindrical section extending upward from the support surface;

a plurality of support collars, each of which has a lower end which forms a circumferential flange that is horizontally and radially expanded, each of the support collars defining a bore and having an outer circumferential surface to which a plurality of lug plates is mounted in an equally and angularly spaced manner, the support collar comprising a hollow cylindrical section extending upward from the lug plates;

a plurality of trays, each of which comprises internal ribs that extend radially from a central hub that defines a central bore, the hub having a top circumference from which a circumferential stop flange extends inward, whereby the bore is greater than an outside diameter of the lug plates and the stop flange defining a hole that is greater than the cylindrical section of the support collar, paired guide blocks being provided on an inside surface of the hub to receive each of the lug plates of the support collar therein; and a coupling collar, which is arranged between the base and a bottom one of the trays that is closest to the base, the coupling collar comprising a hollow tubular body mountable to the base, the coupling collar also comprising a hollow cylindrical section and a projecting section, which comprises a plurality of arms radially extending from the tubular body, the coupling collar being insertable into the central bore of the bottom tray with the arms received in recessed bottoms of the internal ribs of the bottom tray;

whereby the base is coupled to the coupling collar in such a way that the coupling collar is supported by the cylindrical section of the base, the coupling collar is coupled to and supports the bottom tray and the bore of one of the support collars, and the one of the support collars is inserted into and coupled to one of the trays with the guide blocks of the one of the trays engaging the lug plates of the one of the support collars, and the one of the support collars is inserted to another one of the support collars, the another one of the support collars being inserted into another one of the trays, so that the trays are vertically and sequentially stacked, the trays and the support collars being rotatable on the base and other support collars to adjust angular positions thereof to facilitate access of parts stored in the trays.

2. The parts stand as claimed in claim 1, wherein the hollow post of the base comprises reinforcement ribs formed on an inner circumference thereof.

3. The parts stand as claimed in claim 1, wherein each of the support collars further defines a through hole that extends upward from and is in communication with the bore of the support collar and comprises reinforcement ribs therein.

4. The parts stand as claimed in claim 1, wherein the internal ribs of each of the trays have top faces in which through holes are defined.

5. The parts stand as claimed in claim 1, wherein the internal ribs of each of the trays are made hollow.

6. The parts stand as claimed in claim 1, wherein each of the trays forms an outward expanded rim along an outer circumference thereof.

7. The parts stand as claimed in claim 1 further comprising an additional tray that is provided above a top one of the trays and has a size smaller than the trays.

8. The parts stand as claimed in claim 1, wherein the lug plates of the support collars are made L-shaped having a horizontal section on which a bottom of the respective tray is seated and supported.

9. The parts stand as claimed in claim 1, wherein the central bore of each of the trays forms a plurality of cutoffs and wherein a handle retainer that carries a handle has a bottom on which projections are formed and define a circumferential slot, the projections being receivable through the cutoffs of the central bore of the tray to such a location where the slot aligns the stop flange, whereby by rotating the handle retainer, the projections engage and are fixed by the stop flange so as to secure the handle retainer to the tray, and the tray is removable for being carried away to any desired location by the handle.

10. The parts stand as claimed in claim 1, wherein the internal ribs of each of the trays defines storage chambers in the tray and wherein each of the storage chambers of the tray is provided with two opposite pairs of guide blocks to respectively receive opposite end edges of a partition board therein so as to set the partition board inside the storage chamber to further divide the storage chamber into two sub-chambers.

11. The parts stand as claimed in claim 1, wherein the base forms on the outer circumferential surface thereof with a plurality of connection slots and wherein each of the foot members forms a coupling section that is received and coupled to each of the connection slots.

12. The parts stand as claimed in claim 1, wherein each of the foot members has an underside to which a pad is attached.

13. The parts stand as claimed in claim 1 further comprising a ring pad arranged between adjacent ones of the support collars.

14. The parts stand as claimed in claim 1 further comprising a crown tray arranged above the trays, a coupling tube composed of tubular sections extending internally the parts stand, a coupling bar composed of bar segments extending internally through the coupling tube, a bottom cap being mounted to a lower end of the coupling tube to close the lower end of the coupling tube, the coupling bar having opposing top and bottom ends both defining internally threaded holes, wherein the bottom cap and the crown tray define through holes respectively in alignment with the internally threaded holes, threaded fasteners extending through the through holes and engaging the internally threaded holes to secure the bottom cap and the crown tray to the coupling bar.

* * * * *